US006098575A

United States Patent [19]

Mulshine et al.

[11] Patent Number: 6,098,575

[45] Date of Patent: Aug. 8, 2000

[54] COOLANT FILTER WITH COOLANT ADDITIVE SENSOR

[75] Inventors: Brian W. Mulshine, Carol Stream; Edward H. Howell, Wheaton, both of Ill.

[73] Assignee: Navistar International Transportation Corp., Chicago, Ill.

[21] Appl. No.: 09/164,610

[22] Filed: Oct. 1, 1998

Related U.S. Application Data

[60] Provisional application No. 60/075,755, Feb. 23, 1998.

[51] Int. Cl.[7] ..... F01P 5/14

[52] U.S. Cl. ..... 123/41.15; 123/198 E; 210/96.1; 210/104

[58] Field of Search ..... 210/85, 86, 96.1, 210/104, 167, 243; 123/198 E, 41.15

[56] References Cited

U.S. PATENT DOCUMENTS

| | | | |
|---|---|---|---|
| 3,410,764 | 11/1968 | Johnson et al. . | |
| 4,147,596 | 4/1979 | Baboian et al. . | |
| 4,338,959 | 7/1982 | Krueger et al. . | |
| 4,666,582 | 5/1987 | Blankenship et al. | 204/404 |
| 4,782,891 | 11/1988 | Cheadle et al. | 165/134.1 |
| 5,050,549 | 9/1991 | Sturmon | 123/198 E |
| 5,382,355 | 1/1995 | Arlozynski . | |
| 5,435,346 | 7/1995 | Tregidgo et al. | 137/564.5 |
| 5,647,305 | 7/1997 | Mulshine et al. . | |
| 5,856,198 | 1/1999 | Joffe et al. | 436/100 |

FOREIGN PATENT DOCUMENTS 6-257431 9/1994 Japan .

OTHER PUBLICATIONS

"Prevent Cavitation", Brochure CGE–445, Navistar International Transportation Corp.

*Primary Examiner*—Tony M. Argenbright
*Assistant Examiner*—Hai Huynh
*Attorney, Agent, or Firm*—Dennis Kelly Sullivan; Jeffrey P. Calfa

[57] ABSTRACT

A replaceable coolant filter assembly includes a housing, a filter element having and an end plate to define a fluid path through said filter and comprising a coolant additive sensor having a sacrificial sensing element disposed within said housing in contact with said fluid path. An electrical circuit connecting a microprocessor to the sensing element is grounded through the filter housing to an engine, the microprocessor being responsive to the opening of said sensing element circuit by corrosion an alarm device.

7 Claims, 2 Drawing Sheets

COOLANT FILTER WITH COOLANT ADDITIVE SENSOR

RELATED APPLICATIONS

This application claims the benefit of U.S. Provisional application Ser. No. 60/075,755, filed Feb. 23, 1998, which application is incorporated herein in its entirety.

BACKGROUND OF THE INVENTION

The present invention relates to cooling systems for internal combustion engines, especially diesel engines, and, more particularly, to a replaceable cooling system filter having a coolant additive sensor to sense and advise that engine coolant additives are needed.

THE PRIOR ART

It is known that the chemical composition of engine coolant changes throughout the life of the coolant. Long term studies indicate that over 40% of engine problems are either directly or indirectly related to improper coolant formulation or to inadequate maintenance of the various coolant additives. Coolant additives provide buffering by controlling pH and neutralizing acids. They provide general corrosion protection, deter foaming of the coolant; and cavitation erosion protection. They act as a scale inhibitor, to preventing deposits on hot surfaces, and as anti-fouling agents, to limit oil and dirt build-up on metal surfaces. As the additives become depleted during the life of the coolant, the acidity level in the coolant increases and makes the coolant more corrosive.

U.S. Pat. No. 5,647,305 provides a coolant sensor for mounting in a vehicle radiator which uses corrosion of an electrical junction between two dissimilar metals to detect and indicate a corrosive condition in the cooling system by breaking an electrical circuit and causing a light or alarm to be activated. However, the system shown therein requires an additional sensor in the cooling system which itself requires maintenance and occasional replacement to maintain its function.

SUMMARY OF THE INVENTION

Accordingly, it is a primary object of the invention to provide a coolant additive sensor system which provides an electrical indication of coolant additive depletion while being automatically replaced during cooling system maintenance.

A more specific object of the invention is to provide a coolant filter assembly having a coolant sensor incorporated therein to produce an indication that coolant additive(s) need to be replenished.

Such object is met by the replaceable coolant filter of the type having an annular filter element having a hollow core disposed within a housing including a side wall, an end cap, and a end plate. The end plate has coolant inlets communicating with the annular space between the housing and the filter element and a coolant outlet communicating with the hollow core to define the fluid path through the filter. A coolant additive sensor is mounted within the fluid path which comprises a corrodable portion, preferably formed by a junction of two dissimilar metals to form portion of a closed electrical circuit connected between the electrically grounded filter assembly and a power source, preferably a vehicle microprocessor connected to a battery. Upon a sacrificial corrosion element being corroded away as a result of additive depletion the open circuit will be sensed by the microprocessor and the microprocessor in response will cause an alarm device, preferably an indicator light on an associated vehicle instrument panel, to be activated to advise that cooling system maintenance is necessary. During such maintenance, the coolant additives will be restored and a new replaceable coolant filter with a new coolant additive sensor will be installed for further operation.

DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 2:
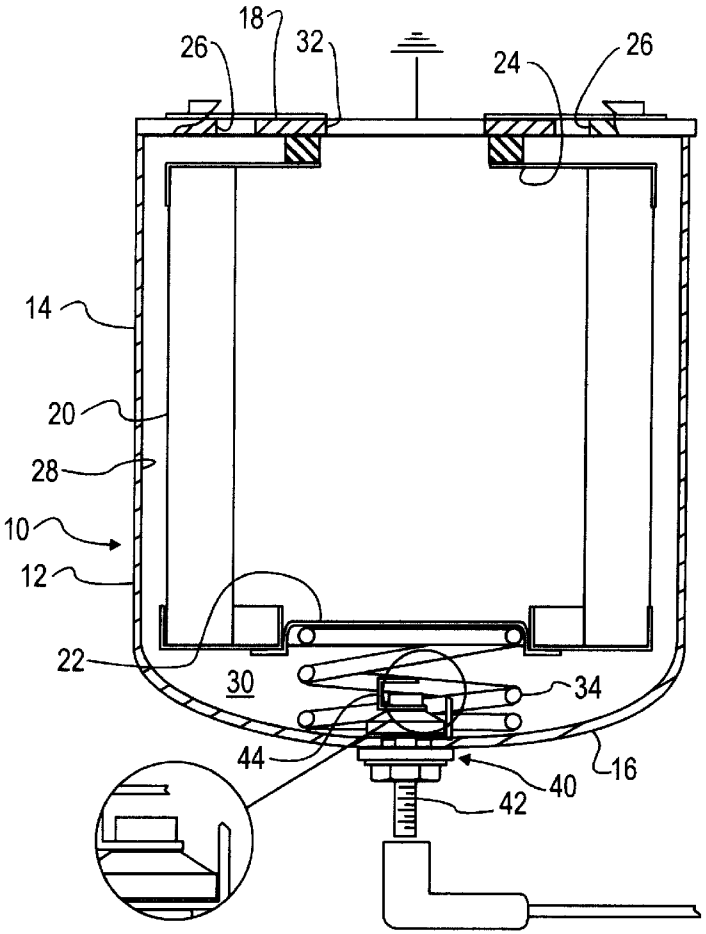
FIG. 2 is an elevational view similar to FIG. 1 showing the sensor destroyed by corrosion to break the electrical circuit.
Figure 1:
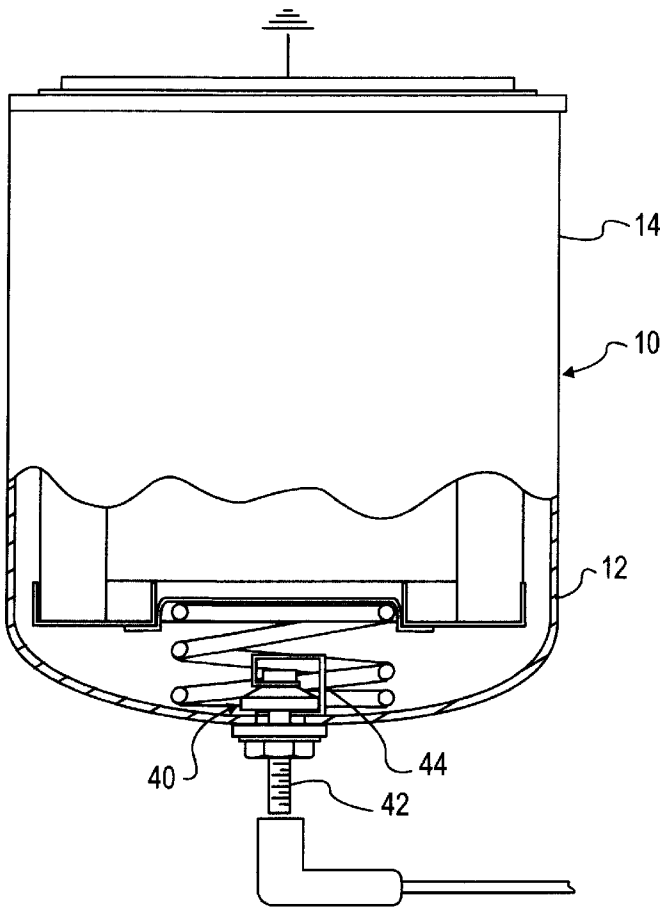
FIG. 1 is an elevational view, partly broken away, of a replaceable coolant filter with coolant additive sensor of the invention and a portion of the sensor circuit, a portion of the filter being broken away to show an intact sensor therein-side.

Referring now to the drawings in greater detail, there is illustrated therein a replaceable coolant filter with coolant additive sensor for indicating the depletion of the coolant engine coolant additives made in accordance with the teachings of the present invention and generally identified by the reference number 10.

As shown, the coolant filter 10 is made of three primary components. One is a filter housing 12 having an annular side wall 14, a curved end cap portion 16 formed with the side wall, and an end plate 18 closing the opposite end of the filter housing 12. Disposed within the housing 12 is a hollow core filter element 20 having a closed core end 22 adjacent the end cap 16 and an open core end 24 adjacent the end plate 18. The end plate has filter inlet openings 26 which provide fluid communication with an annular space 28 between the side wall 14 and filter element, the annular space 28 communicating with the end space 30 between the end cap 16 and the filter element 20. The central portion of the end plate 16 provides a threaded outlet 32 from the hollow core of the element 20. A compression coil spring 34 is disposed in the end space 30 to seal the element 20 against the end plate 18. Thus, a fluid path is created from the inlets 26 to the annular space 28, radially through the filter element 20 to the hollow core thereof, and out through the hollow core end 24 and end plate outlet 32 which is threaded to provide a spin-on attachment of the filter to an associated engine header (not shown). It will be appreciated that the foregoing is a description of a conventional replaceable filter of the spin-on type and that the engine on which the filter is used will have a suitable spin-on type header for supplying coolant to and receiving coolant from the end plate.

Figure 4:
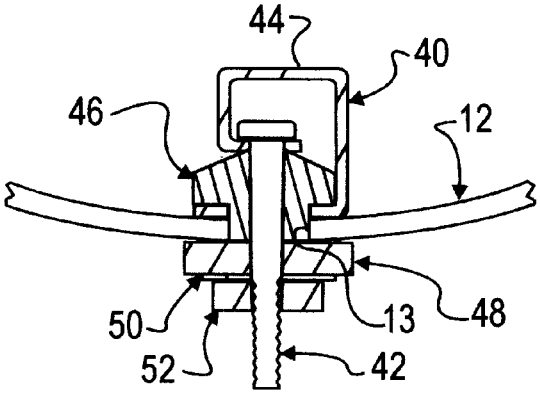
FIG. 4 is a cross section of a portion of the sensor of FIG. 1 taken along the line 4—4 thereof.

In accordance with the invention, a coolant additive sensor 40 is disposed within the housing 12 of the filter 10 preferably within the end space so that the sensor will be on the dirty fluid side of the filter element. The coolant additive sensor 40 may be disposed within said coil compression spring 34 along the axis thereof and includes a terminal screw 42 preferably made of brass, and a corrodable sensing element 44 made of a conductive material, such as magnesium, which will sacrificially corrode, in the presence of coolant having depleted additives. As best seen in FIG. 4, an inner elastomeric isolator sleeve 46 comprised of an elastomeric material is used to insulate and seal the terminal screw 42 from the filter housing 12. The terminal screw 42 is inserted through an axial hole in the magnesium element 44 then through the upper elastomeric sleeve 46. The magnesium element 44 extends from the terminal screw 42 in a U-shaped configuration back to abut against the housing 12 between the isolation sleeve 46 and the housing. The terminal screw 42 extends through a hole 13 in the filter housing 12 to the exterior of the filter 1. An exterior elastomeric sleeve 48 is mounted on the terminal screw 42 outside of the filter housing 12. An washer (isolated by the outer sleeve 48) and nut 52 clamp the sensor elements together with the sensor element 44 being secured in direct electrical contact against the housing 12. In turn, the housing will be grounded against the filter header through the metal to metal contact provided by the spin-on attaching spud (not shown) conventionally provided on the header. Alternatively, a separate grounding wire for the sensor 40 could be provided.

In the preferred embodiment, the element 44 is made of an easily corroded metal, such as magnesium, while the terminal screw 42 is made of a dissimilar material, such as brass. A further requirement is that each of the sensor materials forming the electrical circuit and the filter housing (if used for grounding) be capable of carrying a current.

Figure 3:
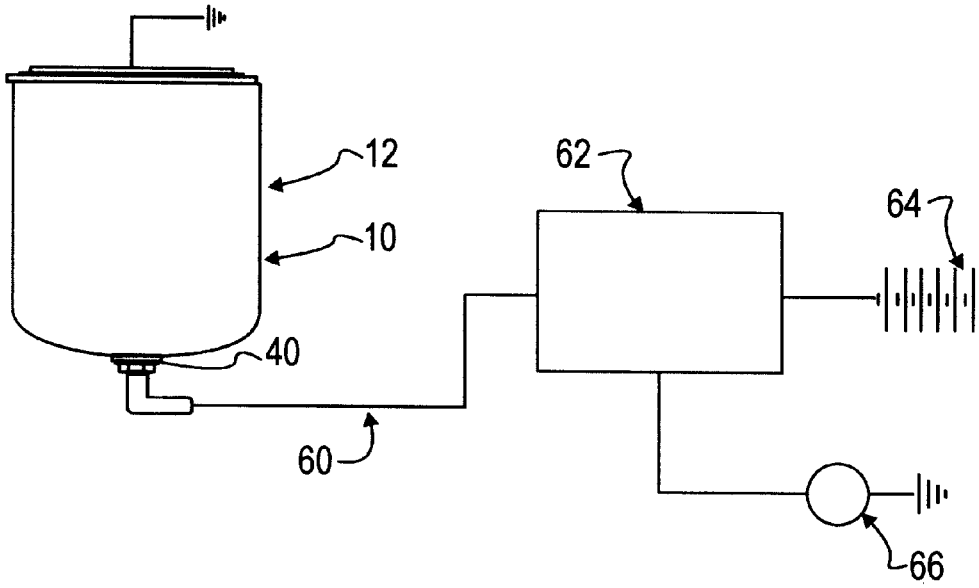
FIG. 3 is a schematic diagram of the electrical circuit for operating the invention.

In this respect, in the electrical circuit for operating the invention, the filter housing 12 and element assembly 40 will be incorporated into a conventional microprocessor-controlled electronic circuit 60 shown schematically in FIG. 3 wherein the terminal screw 42 of the filter housing 12 is connected to an engine electronic control microprocessor 62 which is supplied power from the battery 64. The filter housing 12 grounds the circuit 60 through the filter header (not shown) and the engine (not shown) or an alternative grounding wire from the filter could be used as described above. Since the magnesium element 44 is in direct contact with the filter housing 12, the terminal screw 42 is in direct contact with the magnesium element 44, and the terminal screw 42 is insulated from the filter housing by the use of the elastomeric sleeves 46, 48, the only source of continuity between the terminal screw 42 and the filter housing 12 is the magnesium element 44.

As stated herein before, when the coolant changes chemically and the additives reach a known point of depletion, the coolant becomes corrosive. Thus, with the element 44 situated within the coolant environment, the magnesium element 44 gradually becomes corroded until contact with the terminal screw 42 is broken, as shown in FIG. 2 inset, opening the circuit 60. The microprocessor 62 senses the open circuit and responds thereto by activating the alarm device, preferably a lamp 66 on the vehicle dashboard (not shown), to indicate to the operator that coolant maintenance is required.

Once maintenance is performed, with the corrosion potential of the coolant being once again decreased by addition of coolant additives, the replaceable filter 10 will then be replaced by a new replaceable filter 10 with coolant additive sensor 40. Thus the circuit 60 will be closed again, the alarm light 60 will turn off and future operation of the engine and sensing system can commence.

What is claimed is:

1. In a replaceable coolant filter assembly including a housing having an annular side wall, an end cap, and an end plate, a cylindrical filter element having an annular filter media closed at one end and having a hollow core opened at the other end, the filter element being disposed within said housing in annular spaced relation to said side wall to define an annular space, the end plate having an outlet opening coaxial with the hollow core and inlet openings disposed in spaced relation around the outlet opening and in communication with the annular space before passing radially through the filter media to the hollow core and thereafter out of the outlet opening, thereby defining a fluid path through said filter, the improvement comprising a coolant additive sensor having terminal portion and a sensing portion, wherein the sensing portion is diposed completely within said housing in contact with said fluid path, wherein the sensing portion forms the connection and is electrically connected to the housing for the housing to ground the coolant additive sensor, an electrical circuit connecting said coolant additive sensor to an alarm device, said electrical circuit being responsive to said coolant additive sensor to actuate said alarm device upon said coolant additive sensor indicating depletion of coolant additive from a predetermined amount.

2. The invention in accordance with claim 1 and said electricsl circuit further including a microprocessor having said sensor as an input and said alarm device as an output.

3. The invention in accordance with claim 2 and said electrical circuit further comprising an insulated terminal disposed on said filter housing and extending therewithin to said coolant additive sensor, said sensor connecting said terminal to said housing, said housing being grounded.

4. The invention in accordance with claim 3 and said coolant additive sensor comprising a sacrificial sensing element made of a conductive material which is corrodable upon contact with coolant from which additives are depleted.

5. The invention in accordance with claim 4 and said coolant additive sensor comprising a sacrificial sensing element made of a conductive material which is corrodable upon contact with coolant from which additives are depleted.

6. The invention in accordance with claim 4 and said coolant additive sensor being disposed in said end cap of said housing.

7. The invention in accordance with claim 6 and a coil spring disposed within said housing between said end cap and said filter element, said sensor element being disposed within said spring along an axis thereof.

* * * * *